US009756710B2

(12) United States Patent
Ghanoun et al.

(10) Patent No.: US 9,756,710 B2
(45) Date of Patent: Sep. 5, 2017

(54) SYSTEMS, METHODS, AND DEVICES FOR NETWORKED LIGHTING

(71) Applicant: Honeywell International Inc., Morristown, NJ (US)

(72) Inventors: Sahand Ghanoun, Guildford (GB); Nicholas Thomas Kesteven, Horsham (GB)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 14/802,586

(22) Filed: Jul. 17, 2015

(65) Prior Publication Data

US 2017/0019979 A1 Jan. 19, 2017

(51) Int. Cl.

| | |
|---|---|
| ***H05B 37/04*** | (2006.01) |
| ***H05B 37/02*** | (2006.01) |
| *H05B 33/08* | (2006.01) |
| *H05B 37/03* | (2006.01) |

(52) U.S. Cl.

CPC ..... *H05B 37/04* (2013.01); *H05B 37/0227* (2013.01); *H05B 37/0245* (2013.01); *H05B 33/0869* (2013.01); *H05B 37/034* (2013.01)

(58) Field of Classification Search

USPC ..... 315/247, 185 S, 209 R, 224, 225, 291, 315/307–326

See application file for complete search history.

(56) References Cited

U.S. PATENT DOCUMENTS

2003/0057887 A1* 3/2003 Dowling ..... H05B 37/029 315/291
2005/0248299 A1* 11/2005 Chemel ..... H05B 37/029 315/312
2014/0339988 A1 11/2014 Nishigaki et al.
2015/0351200 A1 12/2015 Boehnel

FOREIGN PATENT DOCUMENTS

WO 2014096198 A1 6/2014

OTHER PUBLICATIONS

Search and Examination from related GB Application No. GB1612195.6, dated Dec. 14, 2016, 5 pp.

* cited by examiner

*Primary Examiner* — Tuyet Vo
(74) *Attorney, Agent, or Firm* — Brooks, Cameron & Huebsch, PLLC

(57) ABSTRACT

Systems, methods, and devices for a networked lighting system are described herein. One system includes a controller for a networked lighting system, comprising, a memory and a processor configured to execute executable instructions stored in the memory to receive, from an image sensor, positions of a number of luminaires in a networked lighting system of a building. The controller further configured to create a lighting map of the networked lighting system based on the received number of luminaire positions and change an address assigned to at least one of the number of luminaires based on the lighting map.

20 Claims, 4 Drawing Sheets

SYSTEMS, METHODS, AND DEVICES FOR NETWORKED LIGHTING

TECHNICAL FIELD

The present disclosure relates to systems, methods, and devices for networked lighting.

BACKGROUND

Networked lighting in a building can be controlled by assigning unique addresses to nodes within the network. For example, the unique addresses can be used to create lighting groups and/or scenes in which one or more particular luminaire(s) can be turned on or off, dimmed, or otherwise controlled.

However, after installation, the unique address of each node in a network is typically random, which means that no assumptions can be made as to the relationship between the physical location of the device and its address. This may result in a need for manual intervention to re-address the ballasts to match the lighting plan which shows the specific address of luminaires at each location.

Further, the maintenance of such a system is problematic as there are no methods currently available to automatically address the replaced ballasts if more than one is replaced at a time which means the scene and group settings become invalid. Manual numbering and/or updating can result in lost time and productivity.

DETAILED DESCRIPTION

Figure 1:
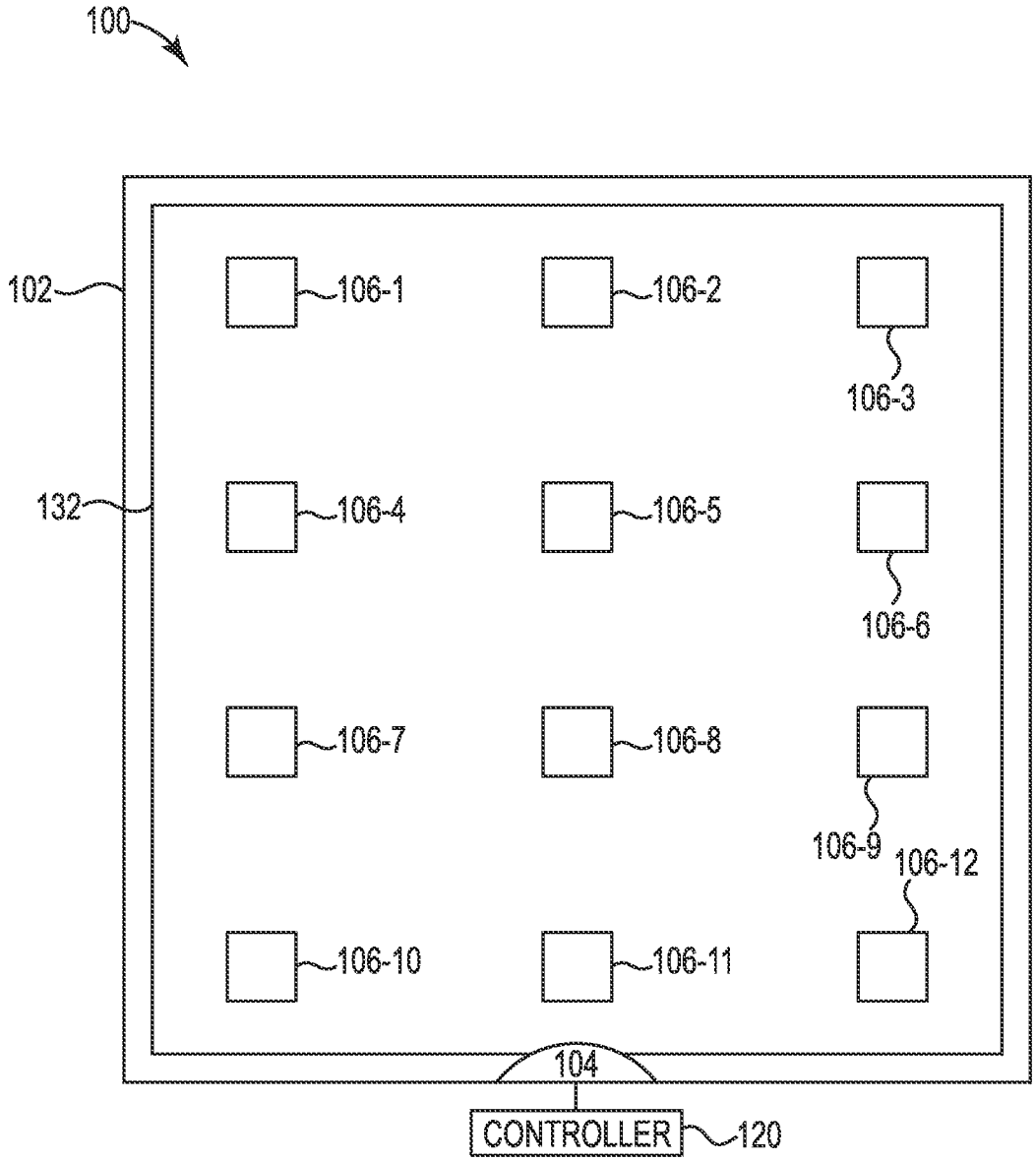
FIG. 1 illustrates a system for networked lighting, in accordance with one or more embodiments of the present disclosure.

Systems, methods, and devices for networked lighting are described herein. For example, one or more embodiments includes a controller for a networked lighting system, comprising, a memory and a processor configured to execute executable instructions stored in the memory to receive, from an image sensor, positions of a number of luminaires in a networked lighting system of a building. The controller further configured to create a lighting map of the networked lighting system based on the received number of luminaire positions and change an address assigned to at least one of the number of luminaires based on the lighting map.

Networked lighting, in accordance with the present disclosure, can allow for a convenient control mechanism by utilizing an image sensor to determine positions of luminaires for use in controlling lighting and/or detecting luminaire failures in a network, such as a building space. An image sensor can be a camera, or a number of cameras, that can capture a lighting effect and/or lighting impact of each particular luminaire. The positions of luminaires in the network can be used to create a lighting map. The luminaires can be assigned a particular address for use in the lighting map, which can allow for easy and convenient control of lighting settings and/or replacement of luminaires within the network or building space. Further, use of the lighting map for a networked lighting system can reduce the time in determining which luminaire is associated with a particular space, which can result in efficient luminaire replacement, lighting plans, and/or luminaire maintenance.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing.

As used herein, "a" or "a number of" something can refer to one or more such things. For example, "a number of cameras" can refer to one or more cameras.

FIG. 1 illustrates a system 100 for networked lighting, in accordance with one or more embodiments of the present disclosure. The system 100 can include a network of lighting within a building space 102, for example. As shown in FIG. 1, the network of lighting can include a number of luminaires 106-1, 106-2, and 106-3, 106-4, 106-5, 106-6, 106-7, 106-8, 106-9, 106-10, 106-11, and 106-n, (collectively referred to herein as the number of luminaires 106), an image sensor 104, and a controller 120.

The number of luminaires 106 can be an artificial light, which includes a fixture body and a lamp (e.g., a light, bulb, etc.). A ballast can regulate a current to the lamp and provide sufficient voltage to start the lamps to produce a sufficient light output. The number of luminaires 106 can be lighting within a building space 102, and may include fluorescent lighting, incandescent lighting, etc.

The image sensor 104 can be a smart optical sensor using a wide angle lens, such as a camera, for detecting the number of luminaire position in the networked lighting system. The image sensor 104 can be positioned on a side wall of the building space and/or a ceiling of the building space 102 to extend a field of view to the floor area of interest. For example, as illustrated in FIG. 1, the image sensor 104 can be positioned on a side wall of the building space 102.

Figure 4:
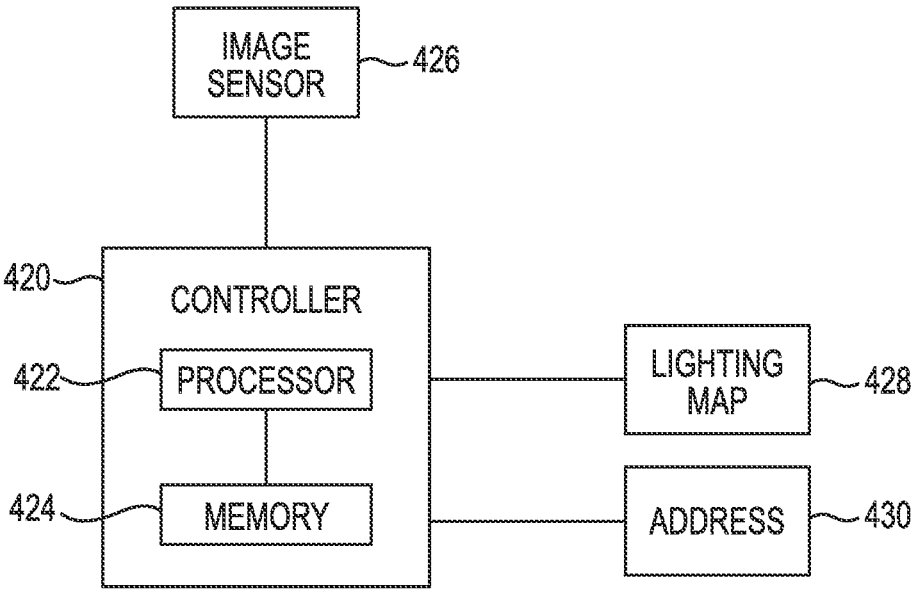
FIG. 4 is a system schematic block diagram of a controller for networked lighting, in accordance with one or more embodiments of the present disclosure.

The controller 120 can include a processor and a memory, as discussed further herein in association with FIG. 4. The controller 120 can, in some embodiments, include a user interface and/or a display. The controller can receive information from the image sensor 104 related to the position of a respective luminaire among the number of luminaires 106. In some examples, the controller can randomly assign an address to the number of luminaires 106. That is, each luminaire among the luminaires 106 may be assigned an initial address to correspond to each luminaire position. For example, luminaire 106-1 may have an address number of 567 assigned, while in contrast, luminaire 106-2 may have an address of 753 assigned at random. That is, each address assigned to each of the number of luminaires 106 may be arbitrary, random, and/or unrelated to surrounding luminaire addresses.

A lighting map 132, in some embodiments, can be created of the networked lighting system based on the number of luminaire 106 positions. The lighting map 132 can, in some embodiments, identify a particular amount of light from each luminaire from the number of luminaires 106. That is, the lighting map 132 can determine an amount of light generated and/or streaming from a particular luminaire among the number of luminaires 106. For instance, each particular luminaire may produce a different amount of light and the lighting map 132 can identify the amount of light from each luminaire. For example, the lighting map 132 can include a lighting effect and/or a lighting impact of each of the number of luminaires 106, as discussed further herein in connection with FIG. 2.

The controller 120, in some embodiments, can change the address assigned to at least one of the number of luminaires 106 based on the lighting map 132. For example, luminaire 106-1 and 106-2 may have been assigned a random address of 567 and 753, respectively. The controller 120 can change the address associated with 106-1 and 106-2 from 567 and 753 to a changed address of 505 and 507, respectively. That is, the controller can change the random address to each luminaire based on the lighting map 132. In some embodiments, the changed address may be based on a sequential factor, such as sequentially numbering each luminaire among the number of luminaires 106. In some embodiments, the changed address may be based on a grouping factor, such as changing an addressed based on a grouping of lighting, as discussed further herein in connection with FIG. 2.

In some embodiments, the address can be changed in response to a detected luminaire failure. A failure, as used herein, can be when the lamp and/or the ballast portion fails. For example, the lamp burns out or power to the lamp is inadequate such that the lamp cannot illuminate. Additionally, a failure, as used herein, can include a partial failure. For example, a partial failure can include partial illumination of the lamp, or when the lamp may indicate burning out (e.g., light flickering).

In some embodiments, the controller 120 can monitor the positions of the number of luminaires 132 using the lighting map. For example, the controller can continue to monitor the positions of each luminaire using the image sensor 104 and the lighting map, from which a failure may be detected. That is, monitoring the number of luminaires 106, using the lighting map 132 can be used to detect a failure. For instance, the controller 120 can continue to receive information from the image sensor 104, which can assist in determining whether a luminaire failure is present. In some examples, a comparison between a baseline image and the lighting map can be used to determine the lighting impact of each luminaire, as discussed herein in connection with FIG. 2.

Figure 2:
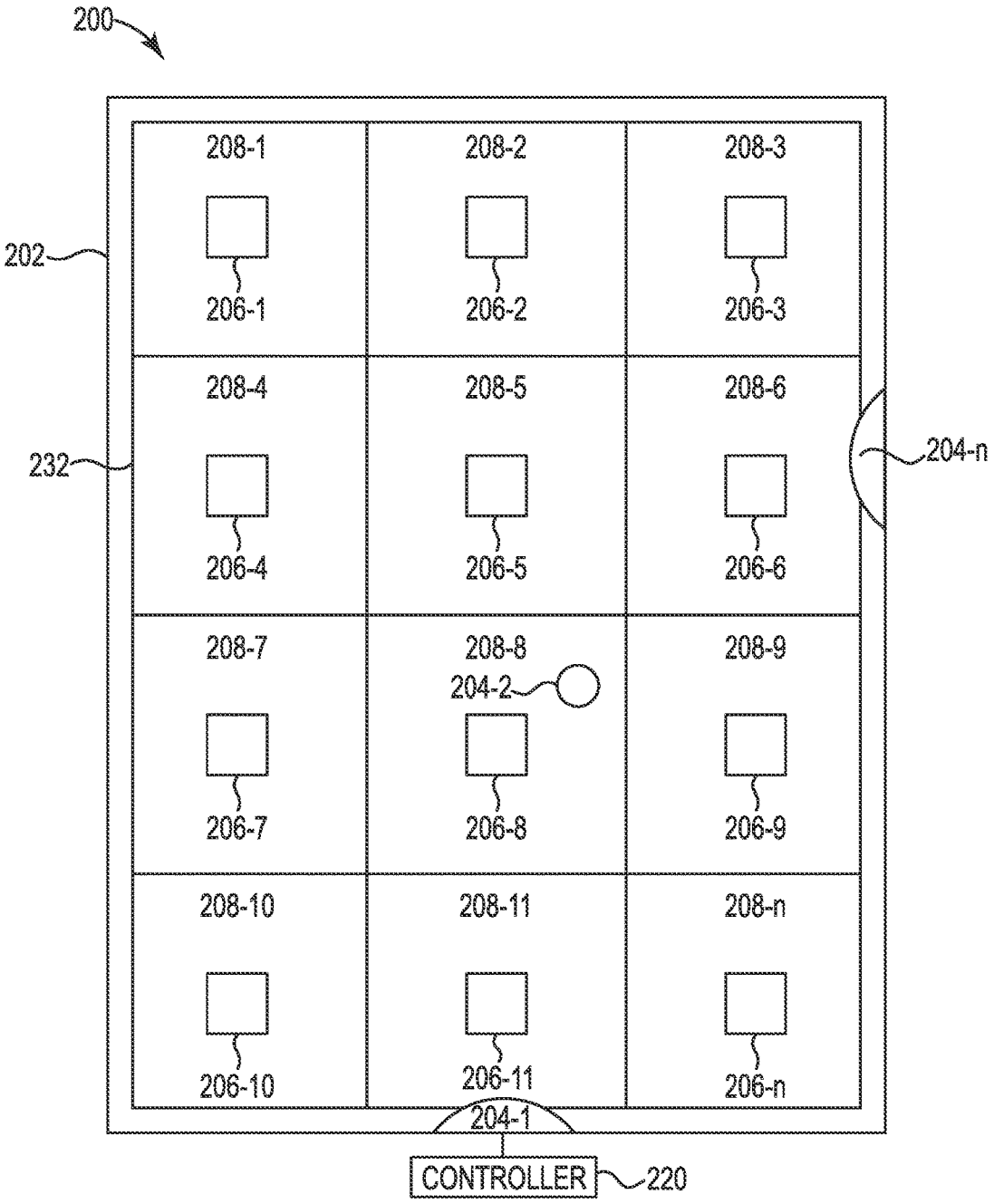
FIG. 2 illustrates a system for networked lighting, in accordance with one or more embodiments of the present disclosure.

FIG. 2 illustrates a system 200 for networked lighting, in accordance with one or more embodiments of the present disclosure. As illustrated in FIG. 2, a networked lighting system 200 can include a number of image sensors 204-1, 204-2, 204-3, 204-4, 204-5, 204-6, 204-7, 204-8, 204-9, 204-10, 204-11, and 204-n (collectively referred to herein as image sensors 204), a plurality of luminaires 206-1, 206-2, 206-3, 206-4, 206-5, 206-7, 206-8, 206-9, 206-10, 206-11, 206-n (collectively referred to herein as plurality of luminaires 206), and controller 220.

The number of image sensors 204 and plurality of luminaires 206 can be analogous to the image sensor 104 and the number of luminaires 106, respectively, described in connection with FIG. 1. The controller 220 can operate in an analogous manner as previously described in FIG. 1, and as further described herein in connection with FIG. 4.

As illustrated in FIG. 2, the number of image sensors 204 can identify positions of each of the plurality of luminaires 206 in a networked lighting system 200 of a building space 202 based on light generated 208 by each respective luminaire. In some embodiments, the number of image sensors 204 can sense a particular amount of light from each luminaire. That is, the light generated 208-1, 208-2, 208-3, 208-4, 208-5, 208-6, 208-7, 208-9, 208-10, 208-11, 208-n (e.g., generally referred to herein as light generated 208) by each respective luminaire can be unique to each respective luminaire. That is, each luminaire can generate a particular amount of light to illuminate a portion of the building space 202.

The light generated 208 by each respective luminaire (e.g., 206-1, 206-2, etc.) can include a light boundary 234. The light boundary can indicate the area of the building space 202 that can be illuminated from the respective luminaire. For example, the light generated by 208-1 (e.g., depicted as a square) from luminaire 206-1 can include the light boundary 234, which can be the area of the building space 202 illuminated by luminaire 206-1. By way for another example, the light generated by 208-10 from luminaire 206-10 can be the area of the building space 202 illuminated by luminaire 206-1.

In some embodiments, the number of image sensors 204 can capture a baseline image of a floor-lighting plan to determine the amount of light generated by each luminaire. In some examples, the baseline image includes no luminance from the plurality of luminaires 206. For example, the number of image sensors 204 can capture a baseline image (e.g., a first image) of the building space 202. The baseline image can be an image that includes no lighting (e.g., lights off) from the plurality of luminaires 206. That is, the baseline image can be a scene and/or an image that includes the absence of light generated from the plurality of luminaires 206.

The number of image sensors 204, in some embodiments, can compare the baseline image to the lighting map 232 to identify a lighting impact and/or position of each luminaire. For example, the number of image sensors 204 can compare the baseline image (e.g., darkness) to the lighting map 232 to determine the light generated by each respective luminaire. That is, the system 200 can change the state (e.g., on/off) of each luminaire individually and/or capture a baseline image (e.g., a first image) of the scene. A secondary image can be captured and compared to the baseline image (e.g., first image) to compute the differences between the scenes by each luminaire.

In some embodiments, the difference between the baseline image (e.g., first image) and a second image (e.g., subsequent image) can be calculated to determine a position of a luminaire. The position of each luminaire can be determined based on the point of highest luminance (e.g., brightest). In some embodiments, the determined positions can be stored as a baseline lighting map of the building space 102 (e.g., an area). Embodiments are not limited to such examples.

Additionally, or alternatively, in some examples, the baseline image with an absence of luminance from the plurality of luminaires 206 can identify light from a different sources, such as a window. The light from a different source (e.g., light not originating from the plurality of luminaires 206) can be factored into the lighting map 232. That is, a lighting boundary 234 of a particular luminaire may be influenced (e.g., changed, modified) by light from a different source, as discussed further herein.

In some embodiments, the number of image sensors 204 can compare the baseline image to the light generated by each respective luminaire in a sequential order. For example, light generated from each particular luminaire can be compared to the baseline image to determine the light boundary 234, which can indicate an amount of light generated from the luminaire.

The controller 220, in some embodiments, can assign an address to at least one luminaire among the plurality of luminaires 206. For example, the controller 220 can assign an address to luminaire 206-7 to correspond with a particular position in the building space 202. Additionally, or alternatively, the controller 220 can assign an address to each luminaire (e.g., 206-1-206-n). The address(es) can identify, or associate, a particular luminaire with a particular position (e.g. location) in the building space 202.

The controller 220 can receive, from the number of image sensors 204, each position among the plurality of luminaires 206. For example, the controller 220 can receive from the number of image sensors 204 the position of luminaire 206-1 in connection with the building space 202.

The controller 220, in some embodiments, can create a lighting map 232 of the networked lighting system based on each luminaire position from the light generated 208 by each respective luminaire. For example, the controller 220 can use the light generated 208 by each respective luminaire to determine the position of the luminaire 206-1 in connection with the building space 202 to create a lighting map 232. The lighting map can identify the position of each luminaire among the plurality of luminaires 206 and the light generated 208 from each luminaire. The lighting map 232 can factor in light from a different source to modify the light boundaries 234. That is, the lighting map 232 can be compared to the baseline image to detect differences between the images and to identify failed or replaced lighting ballasts.

In some embodiments, the controller 220 can change an address assigned to the at least one luminaire of the plurality of luminaires 206 based on the lighting map 232. For example, the controller 220 can change an address assigned to a luminaire such that the address assigned to the luminaire is no longer random. The address assigned to the luminaire may be changed automatically, based on the particular location in the building space 202. For example, the address assigned to a luminaire may be changed by the controller 220 such that the address reflects a position of the luminaire, such as assigning an address of 555 for a luminaire in a position on a fifth floor of a building.

In some embodiments, the changed address can be uniquely assigned to the at least one luminaire. For example, each luminaire among the plurality luminaires 206 can have a unique changed address. That is, the changed address(es) associated with each luminaire may be non-identical, non-overlapping, and/or non-repeating. Alternatively, or additionally, the changed address can be assigned based on a sequential numbering order. For example, the plurality of luminaires 206 in the lighting map 232 in the building space 202 can include a sequential order of addresses. For instance, luminaire 206-1 may have an address of 555, while luminaire 206-2 may have an address of 556, while luminaire 206-3 may have an address of 557, etc.

In some embodiments, the changed address can be assigned to a group of the plurality of luminaires 206, where the group is associated with a particular area of the lighting map 232. For example, luminaires 208-4, 208-5, and 208-6 may be a group of plurality of luminaires 206, with assigned addresses of 560, 561, and 563, respectively. The grouping may be identified as group one (e.g., several luminaires as a collective grouping), where group one can include the assigned addresses of 560-563, such that when a command is issued, the group responds in a similar manner. For instance, a command of group one to turn off (e.g., not to generate light) may cause the luminaires 208-4, 208-5, and 208-6, with assigned addresses of 560, 561, and 563 to turn off for a threshold period of time.

In some examples, the controller 220 can notify a user in response to a detected luminaire failure, including a partial failure. A user, as used herein, can include an operator, such as a maintenance person, electrician, etc. The notification may be a textual, visual, and/or an audio message. For example, if the controller detects a failure of luminaire 206-5 (e.g., a lamp burned out, power is inadequate, etc.), the controller can send a textual message to the user to notify the user of said failure. The user can then be informed of the failure and the failure can be addressed (e.g., lamp replaced, power checked, etc.).

Figure 3:
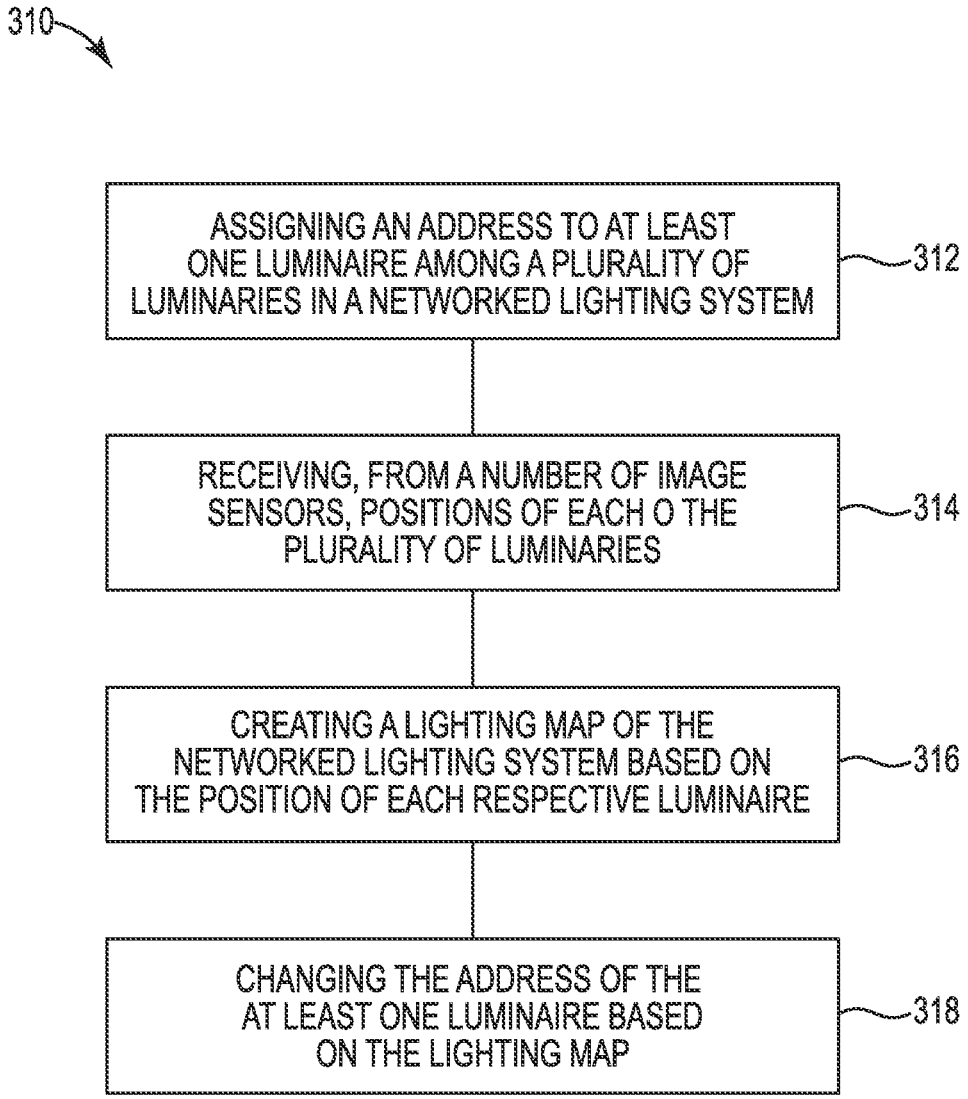
FIG. 3 is a flow chart of a method for operating a networked lighting, in accordance with one or more embodiments of the present disclosure.

FIG. 3 is a flow chart of a method for operating a networked lighting system, in accordance with one or more embodiments of the present disclosure. Method 310 can be performed by, for example, controller 420, as described in connection with FIG. 4.

At block 312 of method 410, the controller can assign, by a controller, an address to at least one luminaire among a plurality of luminaires in a networked lighting system of a building. For example, as previously discussed, the controller can assign addresses to each luminaire. The assigned addresses can be randomly assigned to a luminaire.

At block 314 of method 410, the controller can receive, from a number image sensors, positions of each of the plurality of luminaires. For example, the number of image sensors (e.g., 104 and 204 in connection with FIGS. 1 and 2, respectively) can determine the position of each luminaire based on the respective light generated from each luminaire. That is, the number of image sensors can determine the location of a luminaire based on light generation.

At block 316 of method 410, the controller can create, by the controller, a lighting map of the networked lighting system based on the position of each respective luminaire. For example, the lighting map can include the number of luminaires, the assigned address, and the position of each luminaire. In some embodiments, creating the lighting map can include sequencing the plurality of luminaires to identify the position of each respective luminaire and a particular amount of light generated by each respective luminaire. The position of each respective luminaire can, in some embodiments, be based on lighting generated by each respective luminaire within a particular space. The lighting map can provide information regarding the amount of light generated from each respective luminaire, as previously discussed in connection with FIG. 3.

At block 318 of method 410, the controller can change, by the controller, the address of the at least one luminaire based on the lighting map. For example, the controller can change an address of a luminaire and reflected in the lighting map. The assigned address in the lighting map can identify the luminaire and whether a failure is detected. In some examples, the address may be changed to a sequential order and/or a grouping address, such that the luminaires may be controlled and/or replaced, as previously discussed in connection with FIG. 3.

In some examples, changing the address to the at least one luminaire can be in response to user input. For example, a user, such as an operator, maintenance person, etc., may manually change the address FIG. 4 is a schematic block diagram of a controller for networked lighting, in accordance with one or more embodiments of the present disclosure. Controller 420 can be, for example, controller(s) previously described in connection with FIGS. 1 and 2, respectively.

The controller 420 can include a memory 424. The memory 424 can be any type of storage medium that can be accessed by a processor 422 to perform various examples of the present disclosure. For example, the memory 424 can be a non-transitory computer readable medium having computer readable instructions (e.g., computer program instructions) stored thereon that are executable by the processor 422 to receive, from an image sensor 426, positions of a number of luminaires in a networked lighting system of a building. Additionally, the processor 422 can execute instructions to create a lighting map 428 of the networked lighting system based on the received number of luminaire positions. Further, processor 422 can execute the executable instructions stored in memory 424 to change an address 430 assigned to at least one of the number of luminaires based on the lighting map.

The memory 424 can be volatile or nonvolatile memory. The memory 424 can also be removable (e.g., portable) memory, or non-removable (e.g., internal) memory. For example, the memory 424 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 424 is illustrated as being located within controller 420, embodiments of the present disclosure are not so limited. For example, memory 424 can also be located internal to another computing resource (e.g., enabling computer readable instructions to be downloaded over the Internet or another wired or wireless connection).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A controller for a networked lighting system, comprising;

a memory; and a processor configured to execute executable instructions stored in the memory to:

receive, from an image sensor, positions of a number of luminaires in a networked lighting system of a building;

create a lighting map of the networked lighting system based on the received number of luminaire positions; and change an address assigned to at least one of the number of luminaires based on the lighting map.

2. The controller of claim 1, wherein the lighting map identifies a particular amount of light from each luminaire from the number of luminaires.

3. The controller of claim 1, wherein the lighting map includes a lighting effect and a lighting impact on the lighting map of each of the number of luminaires.

4. The controller of claim 3, wherein the processor is configured to execute the instructions to compare a baseline image to the lighting map to determine the lighting impact of each luminaire.

5. The controller of claim 1, wherein the changed address is in response to a detected luminaire failure.

6. The controller of claim 5, wherein the detected luminaire failure includes a partial failure.

7. The controller of claim 1, wherein the processor is configured to execute the instructions to randomly assign an initial address to each of the number of luminaires.

8. The controller of claim 1, wherein the processor is configured to execute the instructions to monitor the positions of the number of luminaires using the lighting map.

9. A method for operating a networked lighting system, comprising:

assigning, by a controller, an address to at least one luminaire among a plurality of luminaires in a networked lighting system of a building;

receiving, from a number image sensors, positions of each of the plurality of luminaires;

creating, by the controller, a lighting map of the networked lighting system based on the position of each respective luminaire; and changing, by the controller, the address of the at least one luminaire based on the lighting map.

10. The method of claim 9, wherein creating the lighting map includes sequencing the plurality of luminaires to identify the position of each respective luminaire and a particular amount of light generated by each respective luminaire.

11. The method of claim 9, wherein the method includes determining, the position of each respective luminaire based on lighting generated by each respective luminaire.

12. The method of claim 9, wherein changing the address to the at least one luminaire can be in response to user input.

13. A networked lighting system, comprising:

a number of image sensors configured to identify positions of each of a plurality of luminaires in a networked lighting system of a building based on light generated by each respective luminaire;

a controller, configured to:

assign an address to at least one luminaire among the plurality of luminaires;

receive, from the number of image sensors, each position among the plurality of luminaires;

create a lighting map of the networked lighting system based on each luminaire position; and change an address assigned to the at least one luminaire of the plurality of luminaires based on the lighting map.

14. The system of claim 13, wherein the changed address is uniquely assigned to the at least one luminaire.

15. The system of claim 13, wherein the changed address is assigned based on a sequential numbering order.

16. The system of claim 13, wherein the changed address assigned to of a group of the plurality of luminaires, wherein the group is associated with a particular area of the lighting map.

17. The system of claim 13, wherein the number of image sensors senses a particular amount of light from each luminaire.

18. The system of claim 13, wherein the number of image sensors capture a baseline image of a floor-lighting plan, wherein the baseline image includes no luminance from the luminaires.

19. The system of claim 18, wherein the number of image sensors compare the baseline image to the lighting map to identify a lighting impact of each luminaire.

20. The system of claim 13, further comprising the controller configured to notify a user in response to a detected luminaire failure, including a partial failure.

* * * * *